US010897991B2

(12) United States Patent
Polidoros

(10) Patent No.: US 10,897,991 B2
(45) Date of Patent: Jan. 26, 2021

(54) ROOM SERVICE TABLE

(71) Applicant: IHS Global Design Pty Ltd, Melbourne (AU)

(72) Inventor: Nicholas Polidoros, Melbourne (AU)

(73) Assignee: IHS Global Design Pty Ltd, Melbourne (AU)

( * ) Notice: Subject to any disclaimer, the term of this patent is extended or adjusted under 35 U.S.C. 154(b) by 0 days.

(21) Appl. No.: 16/562,720

(22) Filed: Sep. 6, 2019

(65) Prior Publication Data

US 2020/0077789 A1 Mar. 12, 2020

(30) Foreign Application Priority Data

Sep. 6, 2018 (AU) ..... 2018903320

(51) Int. Cl.

| | |
|---|---|
| ***A47B 31/02*** | (2006.01) |
| ***A47B 1/04*** | (2006.01) |
| *E05D 3/16* | (2006.01) |
| *A47B 31/00* | (2006.01) |

(52) U.S. Cl.

CPC ..... *A47B 31/02* (2013.01); *A47B 1/04* (2013.01); *A47B 2031/003* (2013.01); *A47B 2220/0072* (2013.01); *E05D 3/16* (2013.01); *E05D 2003/163* (2013.01)

(58) Field of Classification Search

CPC ..... A47B 31/02; A47B 2031/026; A47B 2031/003; A47B 2031/005

USPC ..... 108/1, 6, 7, 91, 50.13; 312/123, 313, 312/281, 250, 258

See application file for complete search history.

(56) References Cited

U.S. PATENT DOCUMENTS

| | | | | | |
|---|---|---|---|---|---|
| 8,486 | A | * | 11/1851 | Hammitt | A47B 17/02 108/3 |
| 235,074 | A | * | 12/1880 | Dolson | A47B 31/02 312/236 |
| 803,485 | A | * | 10/1905 | Higgins | A47B 53/02 312/201 |
| 1,216,030 | A | * | 2/1917 | Wigins | A47B 31/02 312/236 |
| 1,652,774 | A | * | 12/1927 | Fraser | A47B 19/06 312/233 |

(Continued)

FOREIGN PATENT DOCUMENTS

| | | |
|---|---|---|
| CN | 201870073 U | 6/2011 |
| CN | 203913965 U | 11/2014 |

(Continued)

OTHER PUBLICATIONS

European Application No. EP—19195292.8-1011, The Extended European Search Report and the European Seach Opinion of the European Searching Authority Dated Oct. 28, 2019 (7 Pages).

*Primary Examiner* — Jose V Chen
(74) *Attorney, Agent, or Firm* — Lawrence N. Ginsberg

(57) ABSTRACT

A room service table, including a table top having two opposing edges; at least two opposing legs adjacent a respective opposing edge, for supporting the table top, the legs having wheels for rolling the table along a surface; a drawer located underneath of the table top for receiving food for room service delivery; wherein the table top is moveably connected to the opposing legs, and whereby the table top and drawer can be tilted upwards with respect to both of the opposing legs to allow nesting together of two or more like room service tables.

26 Claims, 11 Drawing Sheets

(56) References Cited

U.S. PATENT DOCUMENTS 1,803,330 A * 5/1931 Johnson ..... A47B 31/02 312/236
1,956,546 A * 4/1934 Froelich ..... A47B 27/08 108/2
4,372,631 A 2/1983 Leon
4,397,245 A * 8/1983 Washburn ..... B25H 1/18 108/7
4,879,954 A * 11/1989 Sawamura ..... A47B 3/00 108/6
5,101,736 A * 4/1992 Bommarito ..... A47B 21/02 108/10
5,131,333 A * 7/1992 Karasawa ..... A47B 19/06 108/1
5,199,360 A * 4/1993 Koistinen ..... A47B 17/02 108/1
5,240,320 A * 8/1993 Yerman ..... A47B 57/52 312/236
5,410,971 A * 5/1995 Golden ..... A47B 17/02 108/1
5,503,086 A * 4/1996 Hoffman ..... A47B 9/00 108/138
7,614,351 B2 * 11/2009 Piretti ..... A47B 3/0815 108/1
7,836,833 B2 * 11/2010 Kumazawa ..... A47B 3/0815 108/115
8,091,488 B2 * 1/2012 Chirea ..... A47B 7/02 108/115
2005/0252426 A1 * 11/2005 Blasen ..... A47B 7/02 108/91
2010/0307382 A1 * 12/2010 Mammana ..... A47B 41/02 108/5
2014/0285959 A1 * 9/2014 Riley ..... A47C 7/72 361/679.08
2015/0223600 A1 * 8/2015 Pan ..... A47B 41/02 108/91

FOREIGN PATENT DOCUMENTS

CN 107822305 A 3/2018
JP 3173909 U 2/2012

* cited by examiner

ROOM SERVICE TABLE

FIELD OF THE INVENTION

The present invention relates to in room dining and a room service table for delivering food to guests in their room.

BACKGROUND OF THE INVENTION

In room dining is a standard service in most hotels, whereby food is ordered by a guest and it is delivered to the guest's room for consumption within the room. The food is typically delivered on a room service table, being a small table on wheels, at which a guest may sit to consume the food.

In many hotels, the food is kept warm by placing a food cover over the plate. However, in more expensive hotels the food is kept warm in a food warmer. The food warmer is a small insulated box that sits on the underlying frame of the room service table. When the food is delivered to the room, the server will set up the table, open the food warmer and remove the food dish, placing it on the table top for consumption. A problem with such an arrangement is that, with a food warmer in position, limited leg room is provided to allow a guest to comfortably sit at the table to eat.

Due to the limited storage space within hotels, it is desirable that the room service table is able to be effectively stored. This may be achieved by providing a table in the form of a drop leaf table, whereby sections of the table top drop down to reduce the width for storage. The underlying frame may also be collapsible to a certain extent. With existing systems, before collapsing the frame, the food warmer must first be removed. The food warmer is then separately stored, taking up additional room.

It is therefore desirable to provide an alternative room service table that at least in part addresses some of the above issues, or provides a useful alternative.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

Accordingly, the present invention provides a room service table, including:

a table top having two opposing edges;

at least two opposing legs adjacent a respective opposing edge, for supporting the table top, the legs having wheels for rolling the table along a surface;

a drawer located underneath of the table top for receiving food for room service delivery;

wherein the table top is moveably connected to the opposing legs, and whereby the table top and drawer can be tilted upwards with respect to both of the opposing legs to allow nesting together of two or more like room service tables.

The top surface of the table top is preferably generally planar. The legs are preferably panels extending the depth of the table top and may have an exterior that is generally planar. The table top and leg may meet at a mitre joint.

The moveable connection between the table top and the opposing leg may be at least in part pivotal. The moveable connection may also be at least in part displaceable forward/rearward and/or up/down. The table top does not pivot about one leg, but between the two opposing legs, the rotation being in a direction perpendicular to an axis extending between the two opposing legs.

There may be a moveable connection on both of the opposing edges, connecting the table top on both edges to a respective leg.

The moveable connection is preferably a lift mechanism in the form of an articulated quadrilateral. Such a mechanism not only tilts the table top upwardly so that one side is higher than the other, but also moves the lower side forwards as the table top tilts. This is achieved by the pivotal connection of four arms of differing lengths, with one arm remaining horizontally orientated and fixed to the leg and an opposing arm fixed to the table top.

A gas strut may be utilised to assist with lifting of the table top to the tilted orientation. Latching means may be provided between the table top and the legs to lock in the lowered orientation.

The drawer may be an insulated drawer to act as a food warmer. The drawer may additionally include a heating element to ensure heat within the drawer is maintained.

BRIEF DESCRIPTION OF THE DRAWINGS

Further aspects of the present invention and further embodiments of the aspects described in the preceding paragraphs will become apparent from the following description, given by way of example and with reference to the accompanying drawings, in which.

DETAILED DESCRIPTION OF THE EMBODIMENTS

Figure 1:
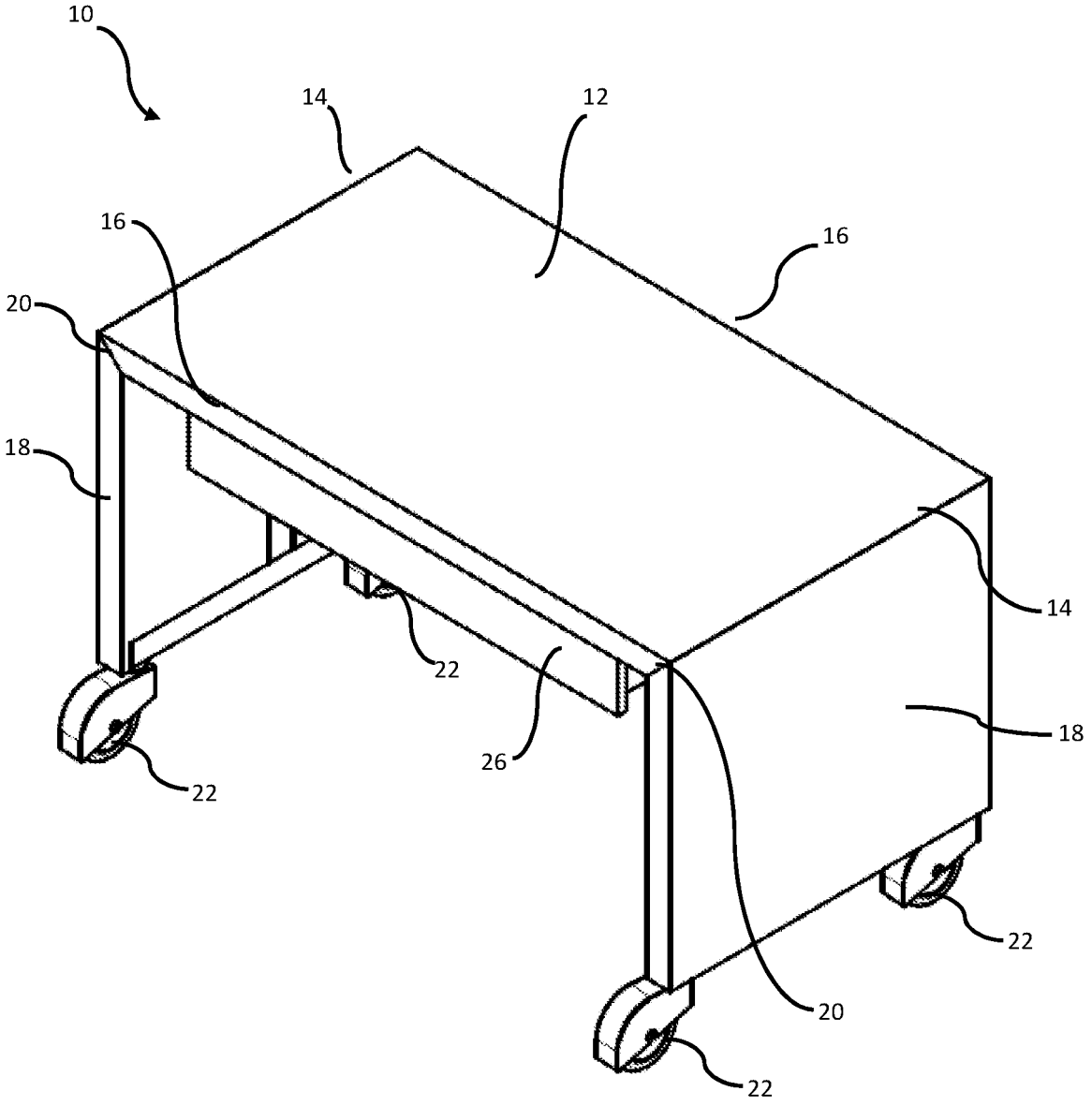
FIG. 1 is a perspective top view of a room service table according to an embodiment of the present invention.

FIG. 1 shows a room service table 10 having a table top 12, which, in use, is positioned generally horizontally. The table top 12 is generally rectangular having two opposing edges 14 and two longitudinal sides 16. Adjacent the two opposing edges 14 are generally upright legs 18. The legs 18 are panel-like in the embodiment shown and have the same width as the depth of the table top 12. The edges 14 of the table top meet with the top edges of the legs at a mitre joint 20 to provide a visually pleasing appearance. However, it will be appreciated that the table top 12 may come to rest on top of legs having a flat top, or any other suitable join may be provided.

Figure 2:
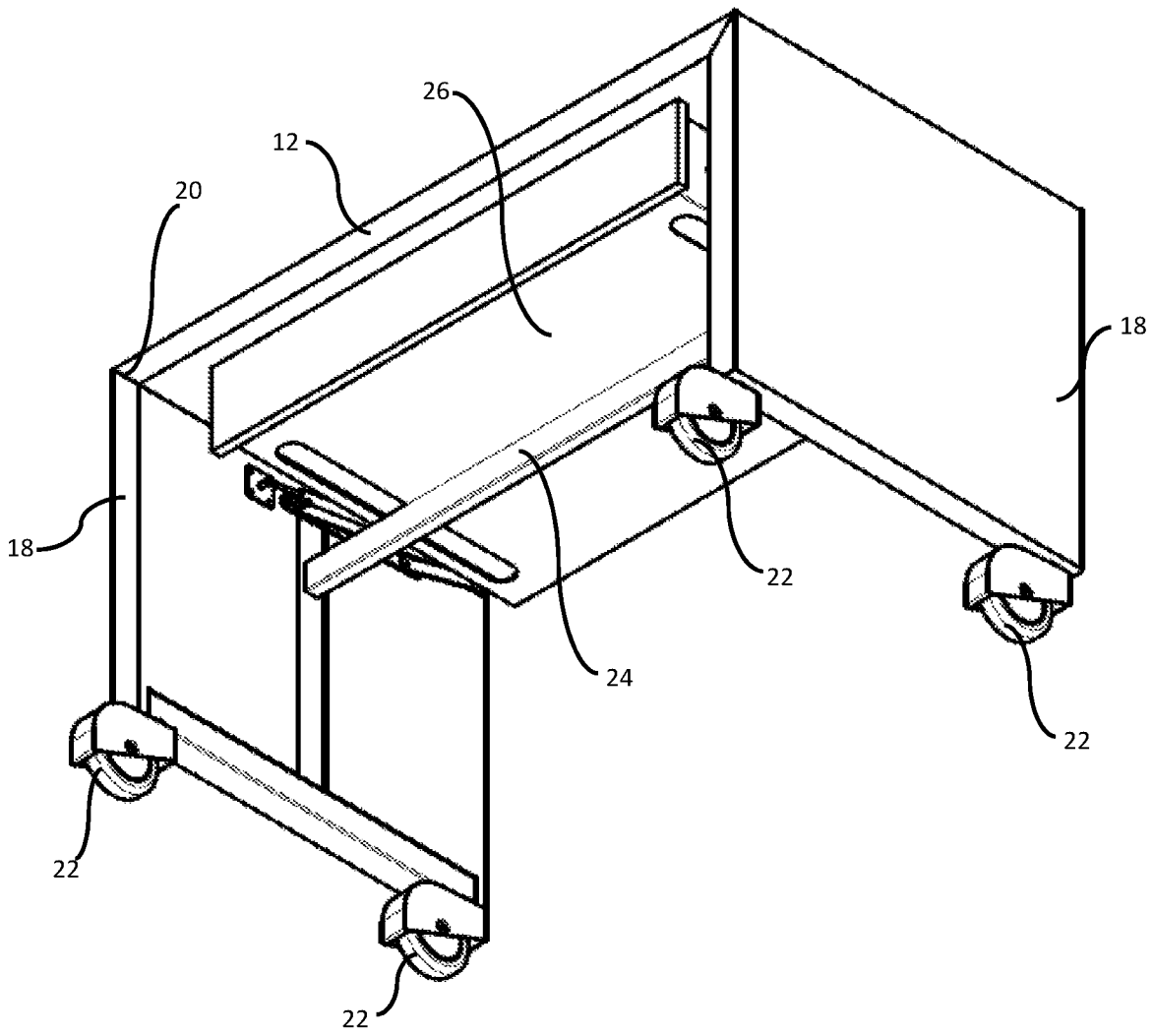
FIG. 2 is a perspective bottom view of the room service table of FIG. 1.

At the bottom of each leg 18 are two spaced apart wheels or casters 22, which allow the room service table to be easily pushed around a hotel to take food to a room for consumption by a guest. The table 10 is such that a guest can readily sit at the table to dine, as there is sufficient leg clearance provided, as shown in FIG. 2. An internal frame member 24 may be provided to brace between the two legs 18.

Figure 3:
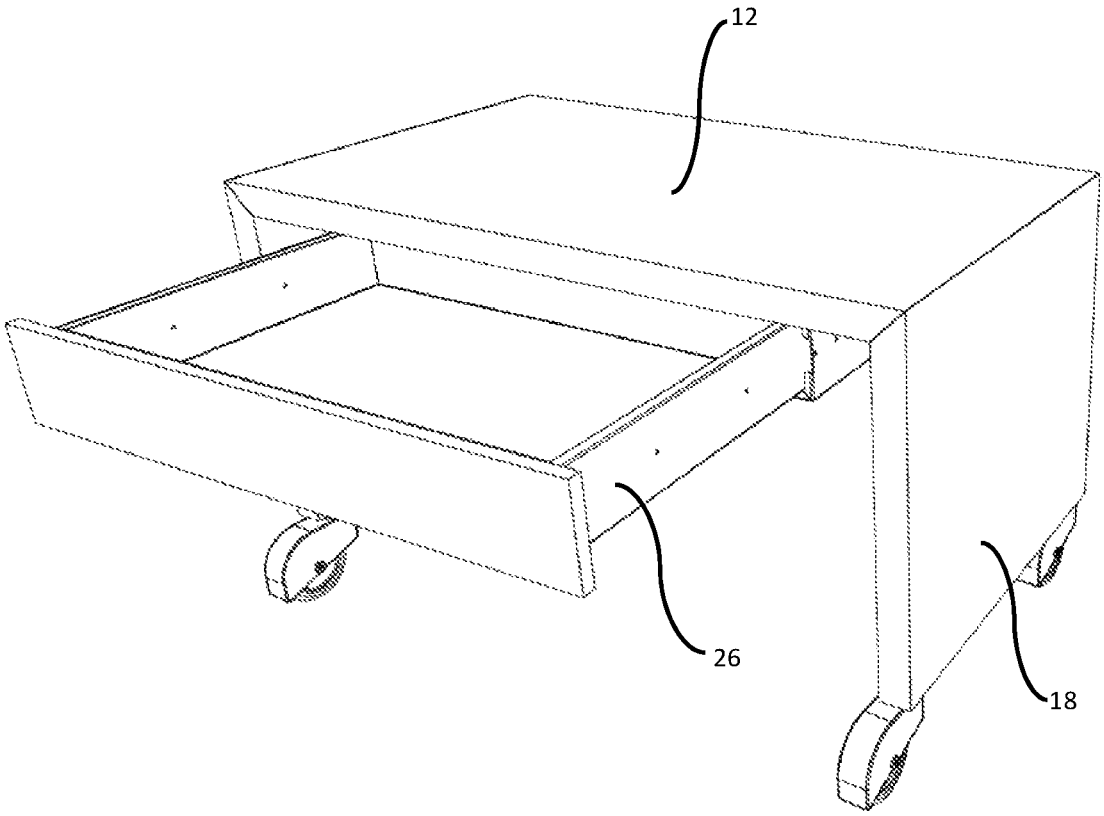
FIG. 3 is a perspective top view of the room service table with the drawer opened.

Positioned directly underneath the table top 12 is a drawer 26. The drawer 26 is rectangular and has a minimum depth in order to receive at least food servings for two people, for example two dinner plates. As shown in FIG. 3, the drawer 26 can be slid outwardly to provide ready access to the food servings held inside. The food serving can then be placed on the table top surface for consumption.

The drawer 26 is insulated in order to keep the food servings warm for an extended period. In some embodiments, a drawer may be able to function as a warming oven by integrating a heating element within it. The heating element may be a fan forced electric element, for example.

Figure 4:
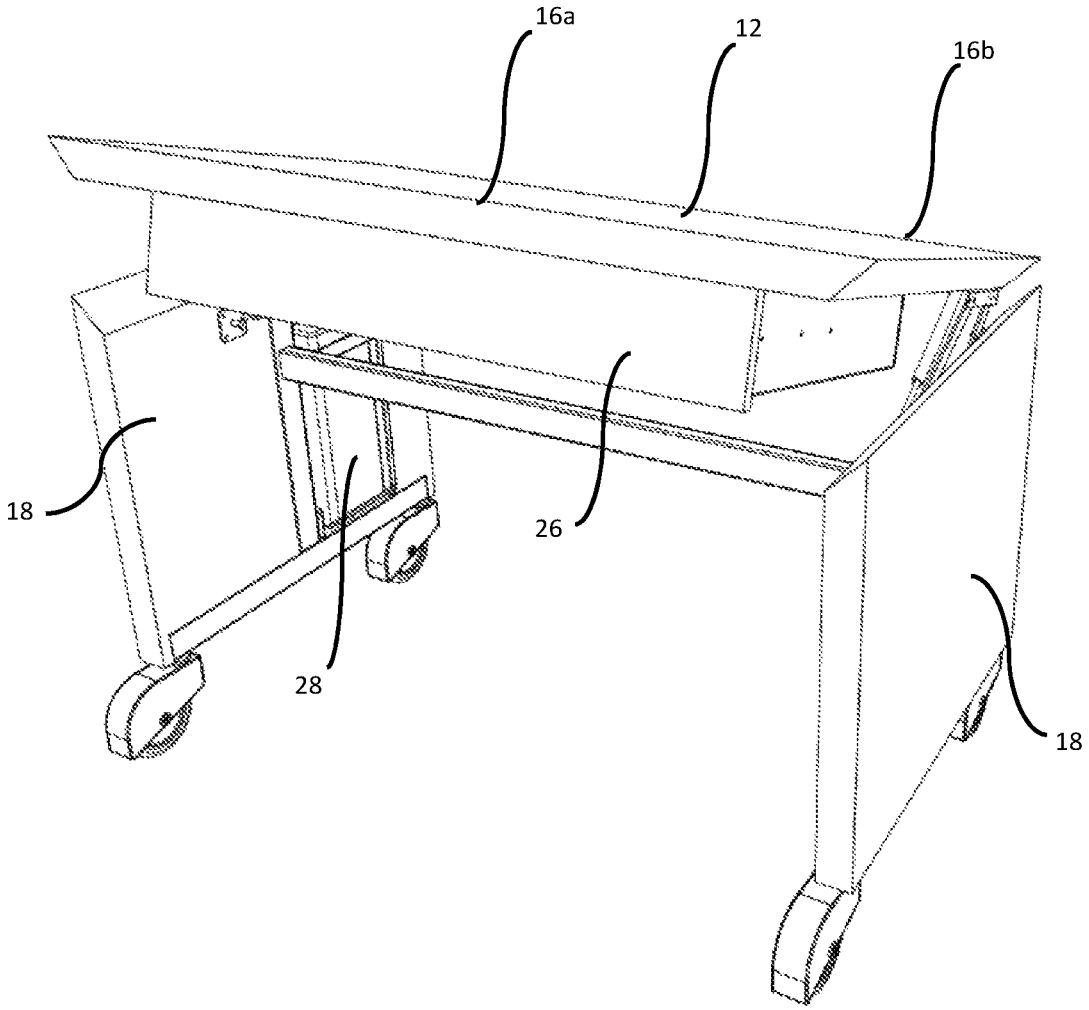
FIG. 4 is a perspective view of the room service table with the table top partially lifted.

A battery pack 28 can be held in a recess on the inside surface of one of the legs 18 (see FIG. 4). The battery pack 28 can be used to power the heating element. It can additionally provide a power point to enable other electrical equipment to be plugged in for use. One example being a toaster that can sit on the table top, allowing the hotel guest to cook their own toast ensuring the guest is provided with hot, crispy toast when they are ready to eat. The battery pack 28 may be removable to allow remote charging, or charging may occur whilst in position.

Figure 5:
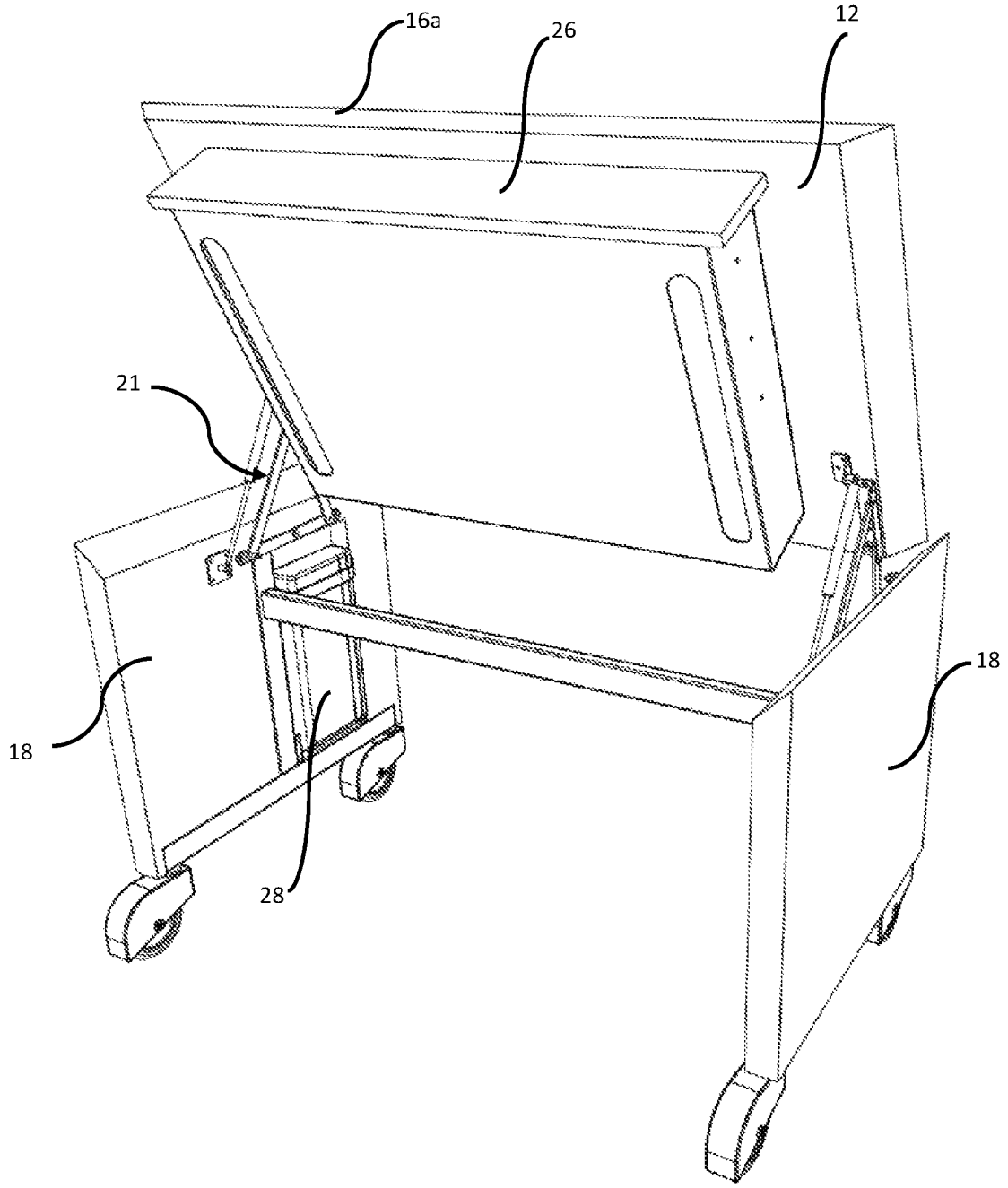
FIG. 5 is a perspective view of the room service table with the table top fully lifted.

To enable ready storage of the room service table 10, the table top 12 is able to be lifted, as shown in FIG. 4. The front side 16*a*, which is the side from which the drawer is accessible, tilts upwards with respect to the rear side 16*b*. The lifting mechanism (21) will be described further below, but in the fully tilted position, as shown in FIG. 5, the table top 12 and underlying drawer 26 is held at an approximate angle of 50 to 70 degrees to horizontal. By tilting the front side 16*a* upwards, the drawer 26 remains closed.

The lifting mechanism will now be described with reference to FIG. 6A through FIG. 6D, which show the progressive lowering of the table top 12. The drawer and one of the legs have been removed from these drawings to enable the lift mechanism to be clearly seen.

Figure 6A:
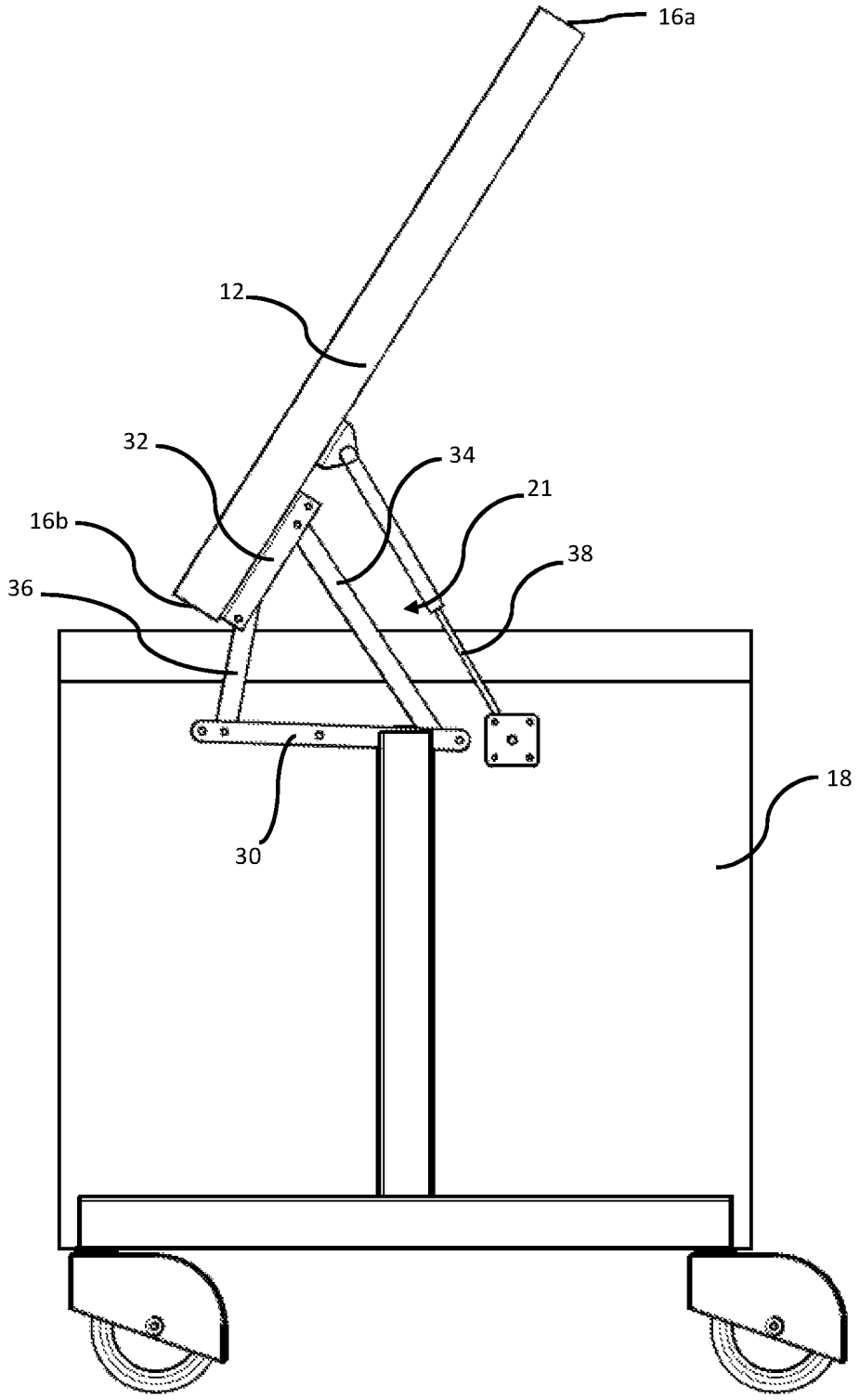
FIGS. 6A through 6D show a side view of the pivot and lifting mechanism in stages of movement, with one leg and the drawer omitted for clarity.

The lift mechanism (21) is an articulated quadrilateral, constructed from four arms. First arm 30 is attached to the inside of a leg 18 in a horizontal orientation. An opposing second arm 32 is fixed to the underside of the table top 12. The first arm 30 is longer than the second arm 32. A third arm 34 extends between the first and second arms 30, 32 towards their ends nearest the front side 16*a*. A fourth arm 36 extends between the first and second arms 30, 32 towards their ends nearest the rear side 16*b*. The third arm 34 is longer than the fourth arm 36. The third arm 34 is also longer than the first arm 30. The second arm 32 and the fourth arm 36 are generally similar lengths. Each of the corner connections between respective arms are pivotal allowing free rotation between arms. As shown in FIG. 6A, in the upright position, fourth arm 36 sits at an angle where its top is tilted toward the front side 16*a*. The third arm 34 sits at an angle where its top is tilted towards the rear side 16*b*.

As shown in FIG. 6A, the table top sits at approximately 60 degrees in the upright position and is held in place by a gas strut 38 that extends between the table top 12 and the leg 18 in front of the lift mechanism. The gas strut 38 is biased to the extended position to assist in lifting.

Figure 6B:
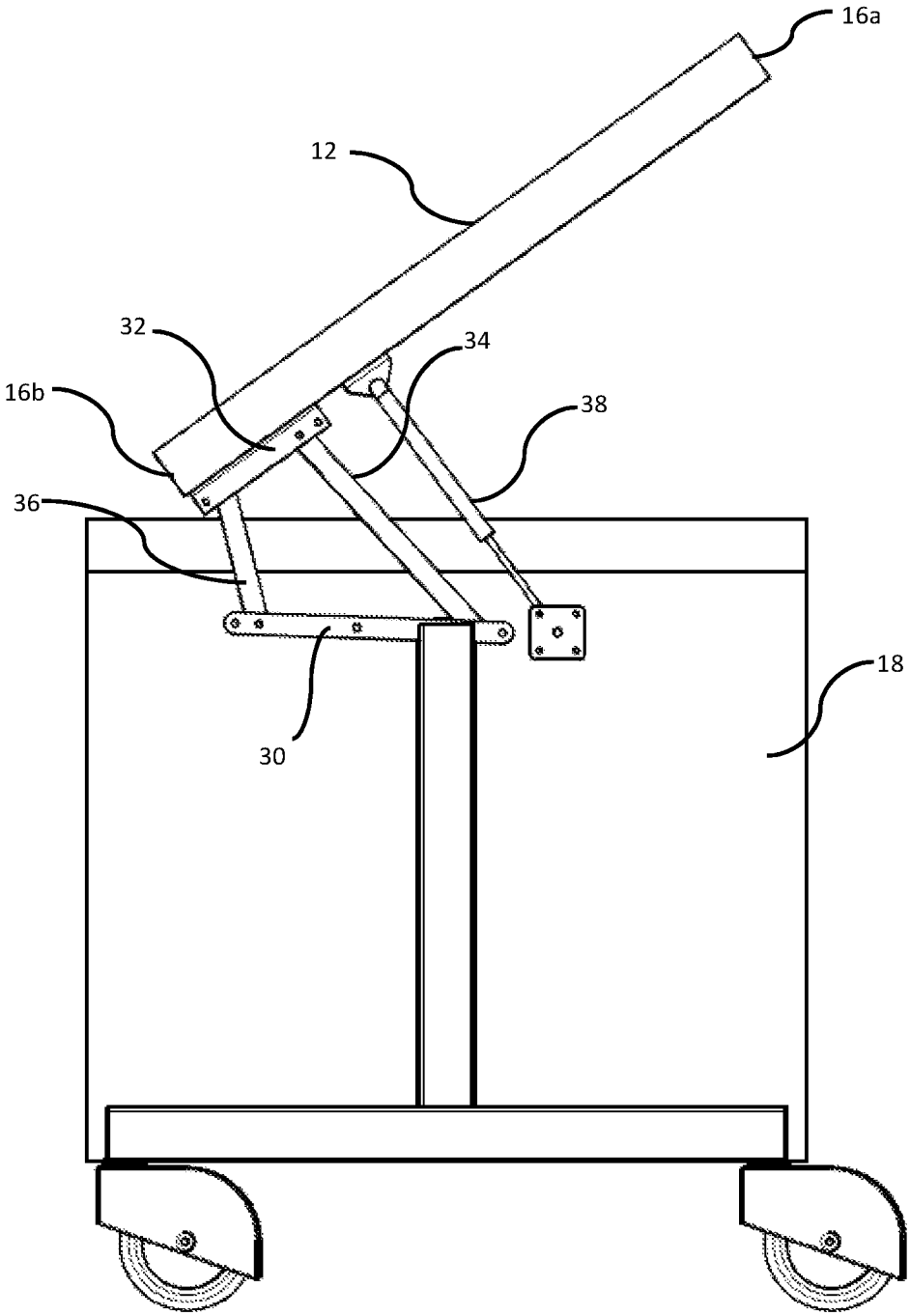

FIG. 6B shows the table top 12 lowered slightly. This would be achieved by a user pushing downwardly on front edge 16*a* overcoming the bias of the gas strut 38. As the front edge 16*a* is lowered, the angle of the second arm 32 is also lowered. This forces rotation of third arm 34 towards the rear side 16*b* and raises rear side 16*b*, also pushing it rearwardly. This has the effect of rotating fourth arm 36 rearwardly also.

Figure 6C:
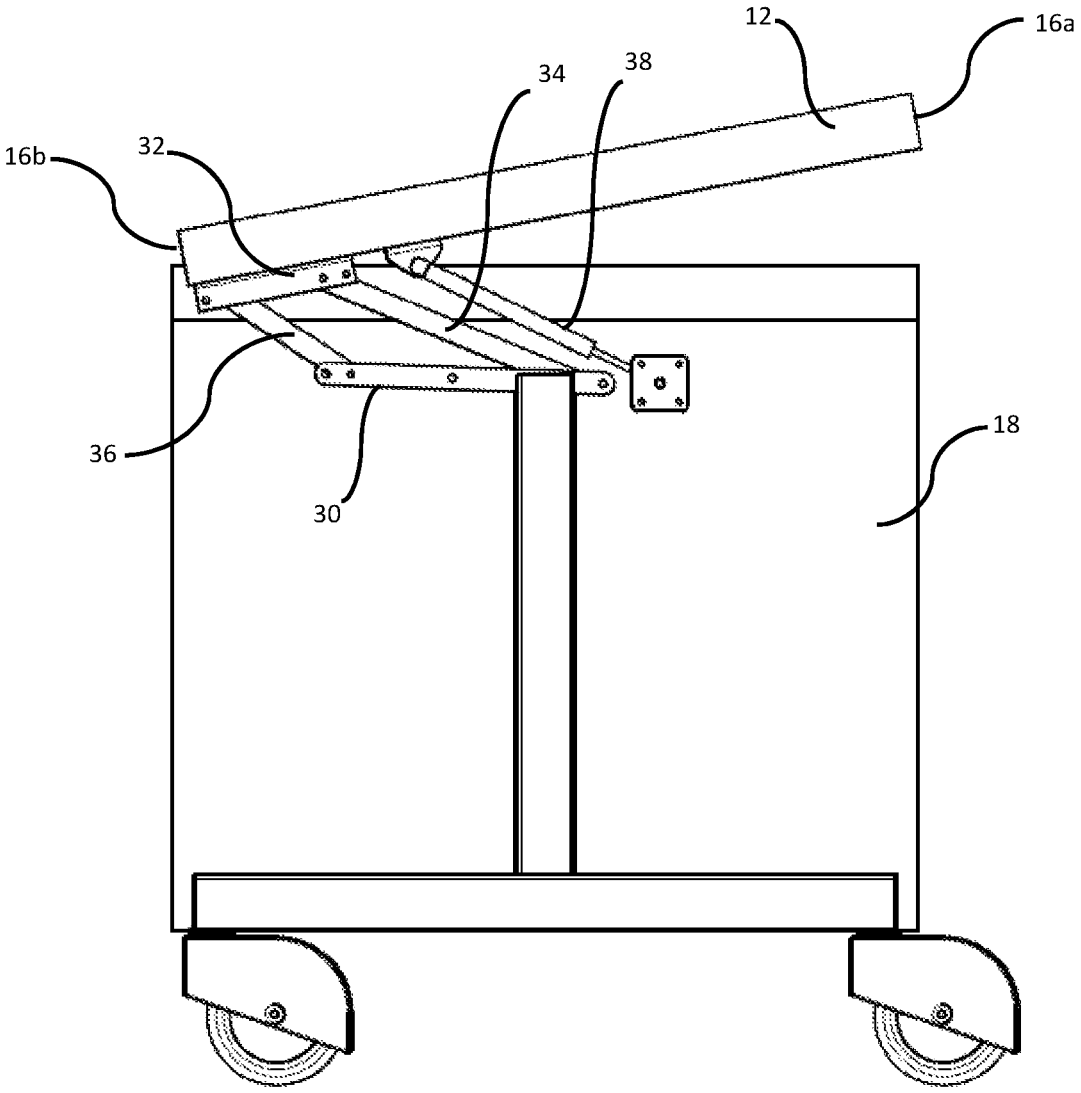

As the table top 12 is lowered further, as shown in FIG. 6C, the third arm 34 and fourth arm 36 continue to rotate rearwardly lowering the second arm 32 and moving it further rearward. The gas strut 38 also pivots with respect to the leg 18 and table top 12 and lowers.

Figure 6D:
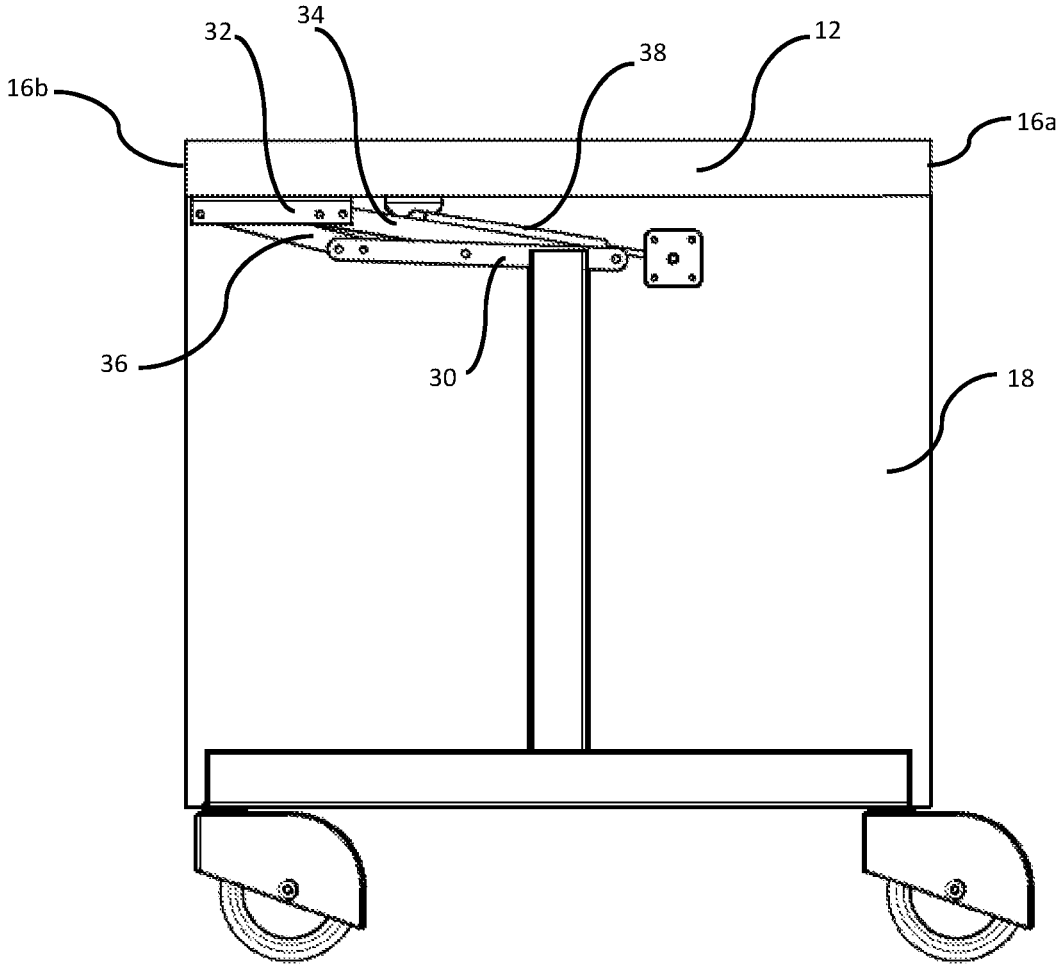

FIG. 6D shows the table top 12 in the fully lowered position. The articulated quadrilateral mechanism is forced into a closed condition, with third arm 34 and fourth arm 36 lying at a small angle to horizontal. This lowered position aligns the rear side 16*b* with the rear side of the leg 18. Latching means (not shown) can be provided between the table top and the legs to lock the table top in the lowered position for use.

Figure 7:
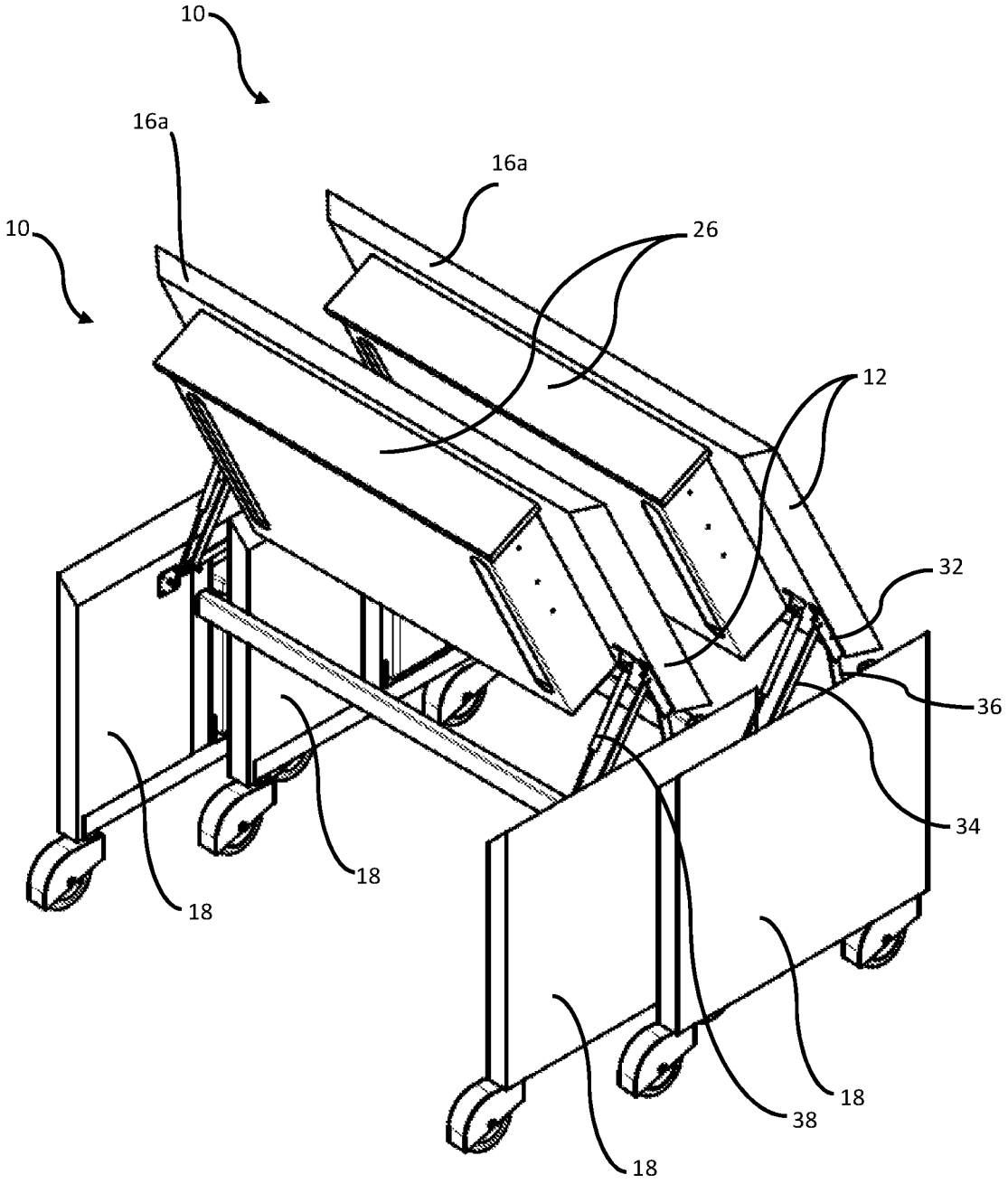
FIG. 7 is a perspective view of two room service tables with their table tops lifted and the tables nesting together.
Figure 8:
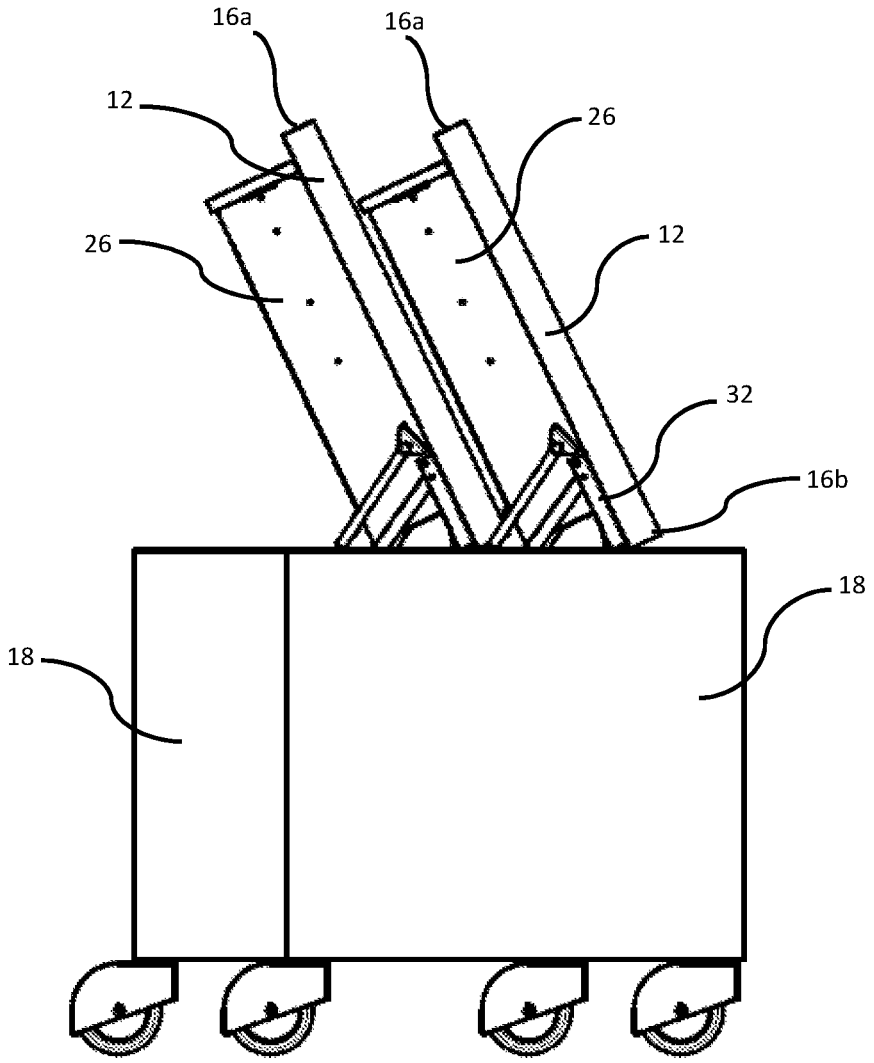
FIG. 8 is a side view of the nested tables of FIG. 7.

Turning back to FIG. 6A, it can be seen that in the raised position, the rear side 16*b* of the table top 12 sits above the top of the legs. This gap provides clearance for multiple tables to be nested, as shown in FIG. 7 and FIG. 8. The nesting occurs by offsetting the legs of one table with respect to another. The tilted table tops and drawers sit against each other.

The present invention provides the advantage of a food warmer drawer integrated into a room service table that is able to be nested for storage without having to first remove the food warmer. This cuts down service times and handling, and reducing potential OHS&S issues with lifting the food warmers.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A room service table, including:

a table top having two opposing edges;

at least two opposing legs adjacent a respective opposing edge, for supporting the table top, the legs having wheels for rolling the table along a surface;

a drawer located underneath of the table top for receiving food for room service delivery, the drawer being an insulated drawer to act as a food warmer and having a heating element to ensure heat within the drawer is maintained;

wherein the table top is moveably connected to the opposing legs, and whereby the table top and drawer can be tilted upwards with respect to both of the opposing legs to allow nesting together of two or more like room service tables.

2. A room service table according to claim 1, wherein the top surface of the table top is planar.

3. A room service table according to claim 1, wherein there are two opposing legs, each being panels extending the depth of the table top.

4. A room service table according to claim 1, wherein the opposing legs have an exterior that is planar.

5. A room service table according to claim 4, wherein the table top and a leg meet at a mitre joint.

6. A room service table according to claim 1, wherein the moveable connection between the table top and the opposing legs is at least in part pivotal.

7. A room service table according to claim 6, wherein the moveable connection is also at least in part displaceable forward/rearward and/or up/down.

8. A room service table according to claim 1, wherein the table top pivots between the two opposing legs, the rotation being in a direction perpendicular to an axis extending between the two opposing legs.

9. A room service table according to claim 1, wherein there is a moveable connection on both of the opposing edges, connecting the table top on both edges to a respective leg.

10. A room service table according to claim 1, wherein the moveable connection is a lift mechanism in the form of an articulated quadrilateral.

11. A room service table according to claim 10, wherein the articulated quadrilateral includes the pivotal connection of four arms of differing lengths, with one arm remaining horizontally orientated and fixed to the leg and an opposing arm fixed to the table top.

12. A room service table according to claim 1, wherein a gas strut is utilised to assist with lifting of the table top to the tilted orientation.

13. A room service table according to claim 12, wherein latching means is provided between the table top and the legs to lock in the lowered orientation.

14. A room service table, including:

a table top having two opposing edges;

at least two opposing legs adjacent a respective opposing edge, for supporting the table top, the legs having wheels for rolling the table along a surface;

a drawer located underneath of the table top for receiving food for room service delivery;

wherein the table top is moveably connected, by a lift mechanism in the form of an articulated quadrilateral, to the opposing legs, and whereby the articulated quadrilateral enables the table top and drawer to be tilted upwards with respect to both of the opposing legs, with the tilted table top sitting above and with a gap to the opposing legs to allow nesting together of two or more like room service tables.

15. A room service table according to claim 14, wherein the top surface of the table top is planar.

16. A room service table according to claim 14, wherein there are two opposing legs, each being panels extending the depth of the table top.

17. A room service table according to claim 14, wherein the opposing legs have an exterior that is planar.

18. A room service table according to claim 17, wherein the table top and a leg meet at a mitre joint.

19. A room service table according to claim 14, wherein the moveable connection between the table top and the opposing legs is at least in part pivotal.

20. A room service table according to claim 19, wherein the moveable connection is also at least in part displaceable forward/rearward and/or up/down.

21. A room service table according to claim 14, wherein the table top pivots between the two opposing legs, the rotation being in a direction perpendicular to an axis extending between the two opposing legs.

22. A room service table according to claim 14, wherein there is a moveable connection on both of the opposing edges, connecting the table top on both edges to a respective leg.

23. A room service table according to claim 14, wherein the articulated quadrilateral includes the pivotal connection of four arms of differing lengths, with one arm remaining horizontally orientated and fixed to the leg and an opposing arm fixed to the table top.

24. A room service table according to claim 14, wherein a gas strut is utilised to assist with lifting of the table top to the tilted orientation.

25. A room service table according to claim 24, wherein latching means is provided between the table top and the legs to lock in the lowered orientation.

26. A room service table, including:

a table top having two opposed edges;

at least two opposing legs adjacent a respective opposing edge, for supporting the table top, the legs having wheels for rolling the table along a surface;

a rechargeable battery held to the room service table and configured to power electrical equipment;

a drawer located underneath of the table top for receiving food for room service delivery, the drawer being an insulated drawer to act as a food warmer;

wherein the table top is moveably connected to the opposing legs, and whereby the table top and drawer can be tilted upwards with respect to both of the opposing legs to allow nesting together of two or more like room service tables.

* * * * *